United States Patent [19]

Rose et al.

[11] 4,031,645

[45] June 28, 1977

[54] TRAY TYPE CARD FILE

[75] Inventors: Lloyd E. Rose, North Smithfield; Joseph P. Maruca, Coventry, both of R.I.

[73] Assignee: Textron, Inc., Providence, R.I.

[22] Filed: Sept. 18, 1973

[21] Appl. No.: 398,439

[52] U.S. Cl. ..... 40/68.6; 40/72

[51] Int. Cl.[2] ..... G09F 11/06

[58] Field of Search ..... 40/68, 68.6, 77.4, 78, 40/67, 124

[56] References Cited

UNITED STATES PATENTS

| | | | |
|---|---|---|---|
| 2,389,923 | 11/1945 | Miller | 40/68.6 |
| 2,522,986 | 9/1950 | Bruen | 40/68 |
| 3,106,920 | 10/1963 | Scholfield et al. | 40/68.6 X |
| 3,253,871 | 5/1966 | Karper | 40/68.6 |
| 3,710,487 | 1/1973 | Saltz | 40/72 |

*Primary Examiner*—John F. Pitrelli

*Attorney, Agent, or Firm*—Cushman, Darby & Cushman

[57] ABSTRACT

Apparatus for supporting a multiplicity of cards of the type having a pair of parallel T-shaped slots formed along one edge thereof, each of which defines a pair of opposed flexible edge tabs. The apparatus comprises a unitary structure molded of plastic material which is arranged to be supported on a horizontal surface. The structure includes front and rear card supporting walls spaced apart to receive the cards therebetween in row formation, a pair of transversely spaced card supporting walls extending between the lower portions of said front and rear walls for supporting the entire row of cards along the portions of the slotted edges thereof extending outwardly from the T-shaped slots therein, and a rail of T-shaped cross-section extending vertically upwardly along the inner portion of each of the transversely spaced walls between the front and rear walls for engaging the slot defining edges of the cards. The rails have transversely enlarged upper rail sections providing downwardly facing surfaces for engaging corresponding opposed flexible tabs of the cards to normally prevent upward movement of the cards out of the row but permitting such movement through flexure of the tabs. The unitary structure is devoid of material in the space disposed vertically beneath and between the opposed enlarged portions of the upper rail sections so that a die structure can move rectilinearly therein after the molding operation has been completed.

12 Claims, 5 Drawing Figures

10
12
14
26
28
30
32
34
36
42
50
3
3

10
12
14
16
18
24
28
32
34
36
40
42
44
46
50
52

14
20
28
32
36
38
40
42
44

TRAY TYPE CARD FILE

This invention relates to card files and more particularly to card files of the tray type.

Tray card files of the type herein contemplated are known and embody a tray structure for receiving and supporting a multiplicity of cards in row formation in a condition such that the row of cards can be divided into two oppositely inclined groups for the purpose of quickly and easily obtaining access to information contained on the faces of any card within the row. The cards heretofore utilized in such files have been formed with a pair of parallel T-shaped slots along one edge thereof, each of which defines a pair of opposed flexible edge tabs. These T-shaped slots enabled the cards to be normally articulately retained in their row formation by engagement on corresponding rails provided on the tray structure, while permitting engagement of new cards and/or disengagement of old cards through deflection of the edge tabs. In the known tray structures, the parallel T-shaped rails constituted separate structural elements requiring separate assembly to the main tray body (see for example, U.S. Pat. No. 2,522,986). The necessity to separately form the rails and effect their assembly to a separately formed main tray body materially contributes to the overall costs of manufacture.

It is an object of the present invention to materially reduce the costs noted above while still providing a tray construction having card receiving rails of full T-shaped cross-sectional configuration. In accordance with the principles of the present invention, this objective is obtained by molding the tray and rails as a unitary structure of plastic material in such a way that the space disposed vertically beneath and between the opposed portions of the upper rail sections extending transversely inwardly of the associated lower rail sections is devoid of plastic material, thus permitting one of the dies used in the molding of the unitary structure to be moved rectilinearly through such space after the molding operation has been completed.

Another object of the invention is to provide an apparatus of the type described which is simple in construction, effective in operation and economical to manufacture.

These and other objects of the present invention will become more apparent during the course of the following detailed description and appended claims.

Figure 1:
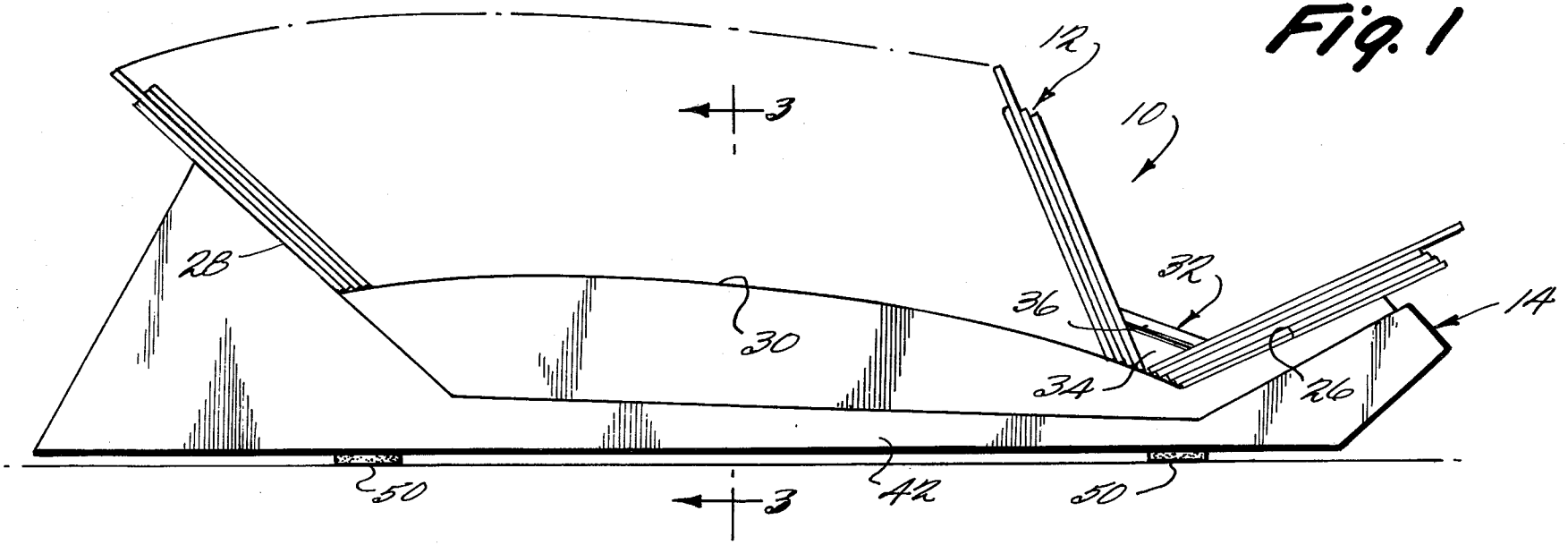
FIG. 1 is a side elevational view of an apparatus embodying the principles of the present invention.

Referring now more particularly to the drawings, there is shown in FIG. 1 thereof an apparatus of the open tray card file type, generally indicated at 10, embodying the principles of the present invention. In general, the apparatus includes a multiplicity of cards, generally indicated at 12, and an open tray type support in the form of a unitary structure, generally indicated at 14, for supporting the cards in row formation so that the row can be divided at any two adjacent cards into two oppositely inclined groups for the purpose of quickly and easily obtaining access to information contained on the faces of any card within the row.

Figure 3:
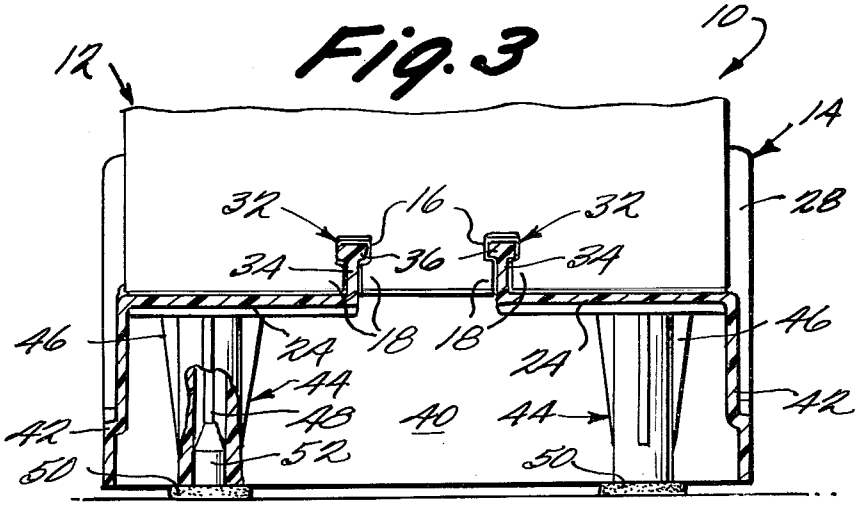
FIG. 3 is a fragmentary sectional view taken along the line 3—3 of FIG. 1 with parts broken away for purposes of clearer illustration.
Figure 2:
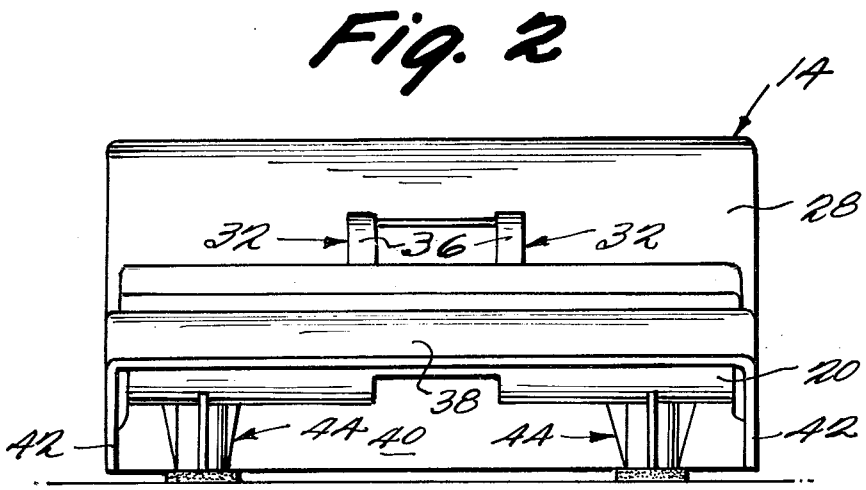
FIG. 2 is a front elevational view of the apparatus shown in FIG. 1 with the cards removed.
Figure 4:
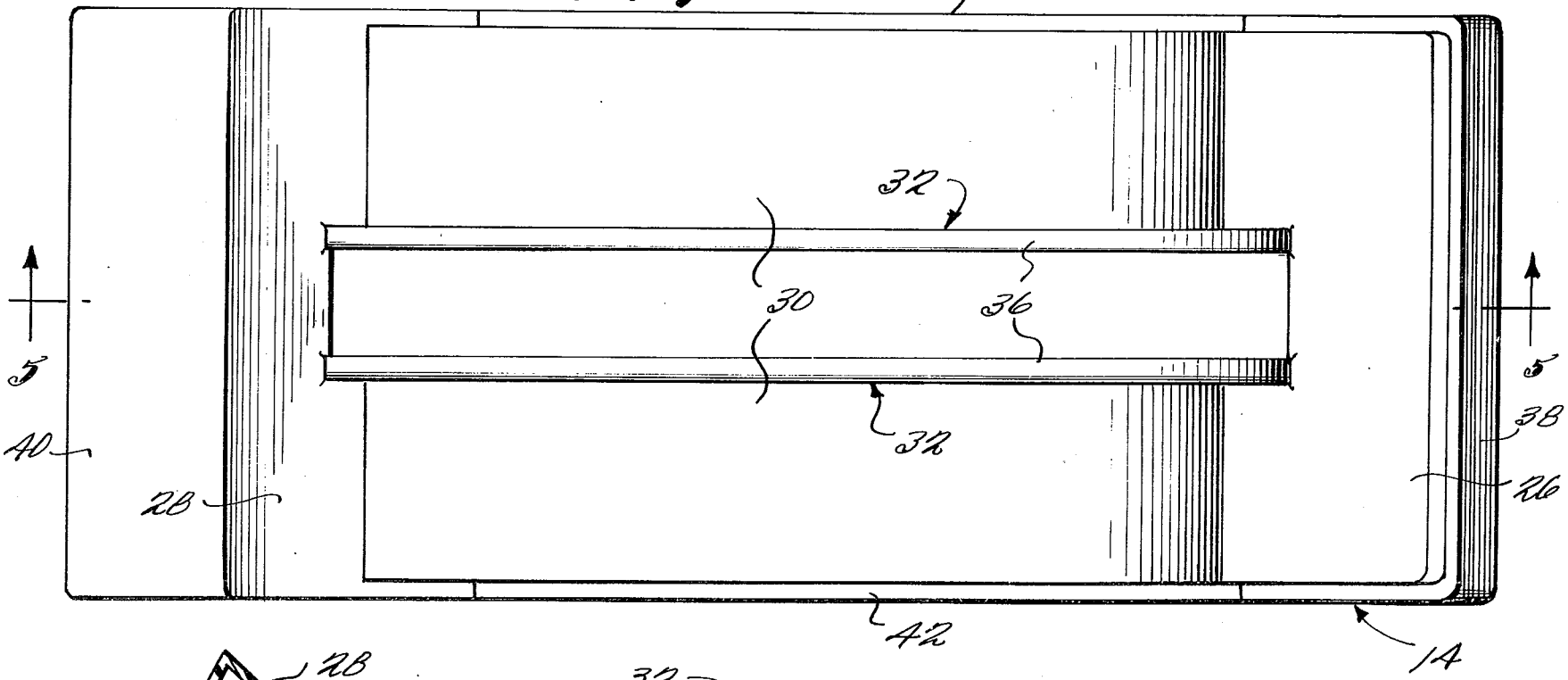
FIG. 4 is a top plan view of the apparatus with the cards removed.
Figure 5:
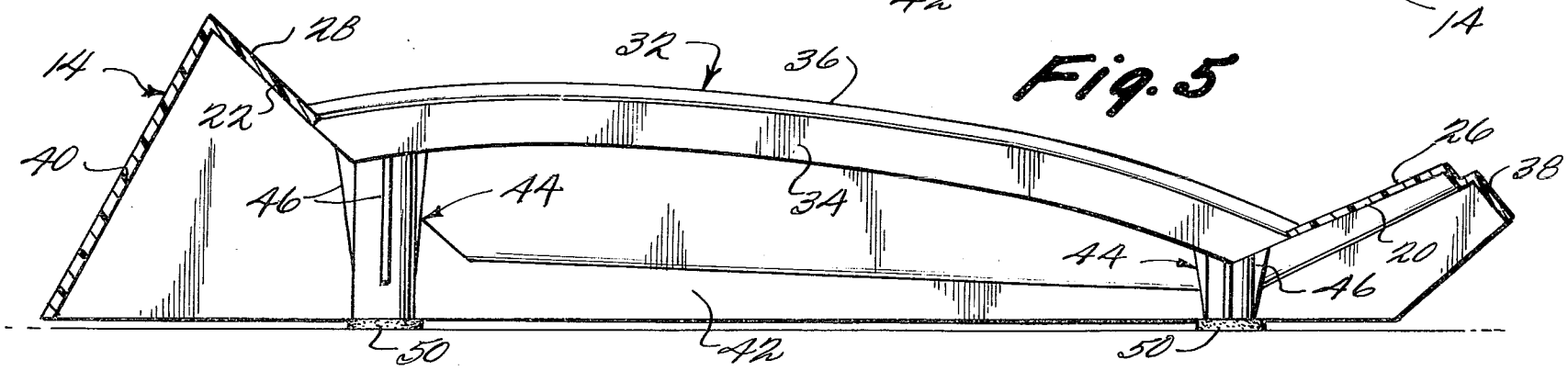
FIG. 5 is a sectional view taken along the line 5—5 of FIG. 4.

The cards 12 are of a known construction and configuration, each being generally rectangular in configuration and having a pair of parallel T-shaped slots 16 formed along one edge thereof. Each T-shaped slot 16 defines a pair of opposed flexible edge tabs 18, which are best shown in FIG. 3.

The support structure 14 is preferably molded as a unitary piece from a plastic material. Any of the well-known plastic materials may be utilized, a preferred embodiment being ABS. The unitary structure includes front and rear card supporting walls 20 and 22 which are spaced apart to receive the cards 12 therebetween in row formation. Extending between the front and rear card supporting walls 20 and 22 is a pair of transversely spaced card supporting walls 24. The walls 20, 22 and 24 define essentially an open tray configuration which serves to basically support the cards in the manner aforesaid.

The forward wall 20 includes a rearwardly and upwardly facing flat surface 26 which serves to support the forwardmost card of the row along the forward face thereof in a forwardly and upwardly inclined position. In the preferred embodiment shown, the flat surface 26 is inclined to the horizontal at an angle of approximately 26°. The rear wall 22 includes a forwardly and upwardly facing flat surface 28 for supporting the rearwardmost card of the row along the rearward face thereof in a rearwardly and upwardly inclined position. In the preferred embodiment shown, the surface 28 is disposed at an angle to the horizontal of approximately 42°.

The two transversely spaced card supporting walls 24 include upwardly facing surfaces disposed in a common plane for supporting the entire row of cards along the portions of the slotted edges thereof extending outwardly from the T-shaped slots therein. In the preferred embodiment shown, the common plane of the upwardly facing surfaces 30 is preferably upwardly convexly arcuate.

In accordance with the principles of the present invention, the support structure 14 also includes a pair of parallel rails, generally indicated at 32, which are of generally T-shaped configuration in cross-section. The rails 32 are engaged within the T-shaped slots 16 of the cards 12 and serve to retain the cards in supported relation on the surfaces 26, 28 and 30 for movement into the two inclined groups as aforesaid.

Each rail 32 includes a lower rail section 34 extending vertically upwardly along the inner edge portion of an associated one of the transversely spaced walls 24 and an upper rail section 36 formed along the upper portion of the lower rail section 34 and extending transversely outwardly therefrom in both directions. It will be understood that the rails provide exterior surfaces facing in both lateral directions for engaging the slot defining edges of the cards to prevent transverse movement thereof out of the row formation. The upper rail sections have downwardly facing surfaces on opposite sides of each lower rail section for engaging corresponding opposed flexible edge tabs 18 of the cards in the row to normally prevent upward movement of the cards out of the row but permitting such movement through flexure of the tabs.

It will be understood that the structure 14 as thus far described is devoid of material in the space disposed vertically beneath and between the opposed portions of the upper rail sections 36 extending transversely inwardly of the associated lower rail sections 34. It will also be understood that this space provides for the rectilinear movement of a die structure therethrough after the molding operation of the structure 14 has been completed.

The preferred embodiment of the support structure 14 includes a plurality of peripheral base walls which serve to strengthen the walls 26, 28 and 30, particularly along their outer free edges. This peripheral base wall structure includes a relatively short front base wall 38 extending downwardly and forwardly from the upper edge of the front card supporting wall 20, a relatively long rear base wall 40 extending downwardly and rearwardly from the upper edge of the rear card supporting wall 28 and a pair of side base walls 42 extending vertically downwardly from the outer lateral edges of the card supporting walls 24, 26 and 28 between the associated edges of the front and rear base walls 38 and 40.

While the base walls could be utilized as the means for supporting the structure on a horizontal surface, in the preferred embodiment shown this function is performed by four legs, generally indicated at 44. In the preferred embodiment shown, each leg 44 is basically in tubular form being substantially cylindrical. Formed inwardly on the outer periphery of each tubular leg 44 is a plurality of circumferentially spaced triangular strengthening ribs 46. The inner periphery of each tubular leg is formed with a plurality of circumferentially spaced elongated strengthening ribs 48.

Disposed below the lower surface of each tubular leg is a pad 50 of resilient material, such as rubber or the like, having an integral stud 52 extending upwardly from the central portion thereof within the interior periphery of the associated leg 44 and in gripping engagement with the interior strengthening 48. The pads 50 serve to support the structure 14 on a horizontal surface in a stable manner against sliding movement during use.

It can thus be seen that there has been provided an apparatus of the type described in which the card supporting structure can be readily molded in a unitary piece so as to provide rails 32 of full T-shaped cross-sectional configuration which cooperate with the T-shaped slots of the cards. The rails extend upwardly from the inner edges of the card supporting walls 24 and have their ends integrally connected with the front and back card supporting walls 20 and 22, thus materially strengthening these four card supporting walls. Further strength is added to these walls by the peripheral base walls 38, 40 and 42 so that the unitary construction is quite strong despite the void of material between the rails 32. Thus, the present unitary construction provides optimum strength with an amount of material minimized by a void space, which provides a functional advantage during manufacture and which is effectively covered by the cards during use.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. Apparatus for supporting a multiplicity of cards of the type having a pair of parallel T-shaped slots formed along one edge thereof, each of which defines a pair of opposed flexible edge tabs, said apparatus comprising a unitary one piece structure molded of plastic material arranged to be supported on a horizontal surface, said structure including front and rear card supporting walls spaced apart to receive a multiplicity of cards therebetween in row formation, said front wall having rearwardly and upwardly facing surface means for supporting a forwardmost card of the row along the forward face thereof in a forwardly and upwardly inclined position, said rear wall having forwardly and upwardly facing surface means for supporting a rearwardmost card of the row along the rearward face thereof in a rearwardly and upwardly inclined position, a pair of transversely spaced card supporting walls extending between the lower portions of said front and rear walls, said transversely spaced walls having upwardly facing surfaces disposed in a common plane for supporting the entire row of cards along the portions of the slotted edges thereof extending outwardly from the T-shaped slots therein, a lower rail section extending vertically upwardly along the inner portion of each of said transversely spaced walls between said front and rear walls, an upper rail section formed along the upper portion of each lower rail section and extending transversely outwardly therefrom in both directions, said rail sections having surface means facing in both lateral directions for engaging the slot defining edges of the cards to prevent transverse movement thereof out of the row formation, said upper rail sections having downwardly facing surface means on opposite sides of each lower rail section for engaging corresponding opposed flexible tabs of the cards to normally prevent upward movement of the cards out of the row but permitting such movement through flexure of the tabs, said structure being devoid of material in the space disposed vertically beneath and between the opposed portions of the said upper rail sections extending transversely inwardly of the associated lower rail sections.

2. Apparatus as defined in claim 1 wherein said rearwardly and upwardly facing surface means comprises a substantial flat surface disposed at an angle of approximately 26° with respect to the horizontal and said forwardly and upwardly facing surface means comprises a substantially flat surface disposed at an angle of approximately 42° with respect to the horizontal.

3. Apparatus as defined in claim 2 wherein the common plane within which said upwardly facing surfaces are disposed is convexly upwardly arcuate.

4. Apparatus as defined in claim 3 wherein said unitary structure includes a front base wall extending downwardly from the upper portion of said front card supporting wall, a rear base wall extending downwardly from the upper portion of said rear card supporting wall and a side base wall extending downwardly from the outer portion of each of said transversely spaced card supporting walls and joined between associated edges of said front and rear base walls.

5. Apparatus as defined in claim 4 wherein said unitary structure includes a pair of longitudinally spaced legs extending downwardly from each of said transversely spaced card supporting walls.

6. Apparatus as defined in claim 5 wherein each of said tubular legs is tubular and includes a plurality of vertically extending, triangular, strengthening ribs spaced annularly about the exterior periphery thereof and a plurality of vertically extending elongated strengthening ribs spaced annularly about the interior periphery thereof.

7. Apparatus as defined in claim 6 including a resilient pad disposed on the lower surface of each leg, each pad having an integral stem extending upwardly from the central portion thereof within the interior periphery of the associated tubular leg in gripping engagement with the elongated ribs thereon.

8. Apparatus as defined in claim 1 wherein said unitary structure includes a front base wall extending downwardly from the upper portion of said front card supporting wall, a rear base wall extending downwardly from the upper portion of said rear card supporting wall and a side base wall extending downwardly from the outer portion of each of said transversely spaced card supporting walls and joined between associated edges of said front and rear base walls.

9. Apparatus as defined in claim 1 wherein said unitary structure includes a pair of longitudinally spaced legs extending downwardly from each of said transversely spaced card supporting walls.

10. Apparatus as defined in claim 9 wherein each of said tubular legs is tubular and includes a plurality of vertically extending, triangular, strengthening ribs spaced annularly about the exterior periphery thereof and a plurality of vertically extending elongated strengthening ribs spaced annularly about the interior periphery thereof.

11. Apparatus as defined in claim 10 including a resilient pad disposed on the lower surface of each leg, each pad having an integral stem extending upwardly from the central portion thereof with the interior periphery of the associated tubular leg in gripping engagement with the elongated ribs thereon.

12. Apparatus of the type described comprising a multiplicity of cards having a pair of parallel T-shaped slots formed along one edge thereof, each of said slots defining a pair of opposed flexible edge tabs, a unitary one piece structure molded of plastic material arranged to be supported on a horizontal surface, said structure including front and rear card supporting walls receiving said multiplicity of cards therebetween in row formation, said front wall having rearwardly and upwardly facing surface means for supporting a forwardmost card of the row along the forward face thereof in a forwardly and upwardly inclined position, said rear wall having forwardly and upwardly facing surface means for supporting a rearwardmost card of the row along the rearward face thereof in a rearwardly and upwardly inclined position, a pair of transversely spaced card supporting walls extending between the lower portions of said front and rear walls, said transversely spaced walls having upwardly facing surfaces disposed in a common plane supporting the entire row of cards along the portions of the slotted edges thereof extending outwardly from the T-shaped slots therein, a pair of parallel rails of T-shaped cross-sectional configuration engaged within the T-shaped slots of said cards so as to permit said row to be divided at any two adjacent cards in the row into two oppositely inclined groups, each of said rails including a lower rail section extending vertically upwardly along the inner portion of an associated one of said transversely spaced walls between said front and rear walls, an upper rail section formed along the upper portion of an associated lower rail section and extending transversely outwardly therefrom in both directions, said rail sections having surface means facing in both lateral directions for engaging the slot defining edges of said cards to prevent transverse movement thereof out of the row formation, said upper rail sections having downwardly facing surface means on opposite sides of each lower rail section for engaging corresponding opposed flexible tabs of the cards to normally prevent upward movement of said cards out of said row but permitting such movement through flexure of said tabs, said structure being devoid of material in the space disposed vertically beneath and between the opposed portions of the said upper rail sections extending transversely inwardly of the associated lower rail sections.

* * * * *